United States Patent [19]

Pastorino

[11] Patent Number: 4,896,153

[45] Date of Patent: Jan. 23, 1990

[54] SYSTEM TO CONTROL AND TEMPORARILY ADAPT SEMAPHORIC REGULATION

[75] Inventor: Giuseppe Pastorino, Genoa, Italy

[73] Assignee: CO.FI.GE. Compagnia Fiduciaria Genovese S.P.A., Genoa, Italy

[21] Appl. No.: 81,299

[22] Filed: Aug. 3, 1987

[30] Foreign Application Priority Data

Aug. 6, 1986 [IT] Italy ..... 48365 A86

[51] Int. Cl.[4] ..... G08G 1/07

[52] U.S. Cl. ..... 340/906; 340/902; 340/907; 340/932

[58] Field of Search ..... 340/906, 907, 902, 930, 340/904, 919; 246/473.1, 38, 44, 125, 127; 49/25, 49

[56] References Cited

U.S. PATENT DOCUMENTS

| | | | |
|---|---|---|---|
| 2,903,674 | 9/1959 | Schwab | 340/906 |
| 3,881,169 | 4/1975 | Malach | 340/906 |
| 4,704,610 | 11/1987 | Smith et al. | 340/906 |

*Primary Examiner*—Donnie L. Crosland

*Attorney, Agent, or Firm*—Samuels, Gauthier, Stevens & Kehoe

[57] ABSTRACT

System to control and temporarily adapt semaphoric regulation, consisting of one first receiving radioelectric equipment (F), equipped with nondirectional aerial, and provided, on roads, buildings, etc., in number suitable for requirements of monitored crossings, to receive and decode signals on a given frequency; one transmitting radioelectric equipment (I), equipped with directional aerial (L), in the same number as that of said receiving radioelectric equipments, suitable for retransmitting said properly reencoded signals, said receiving and transmitting equipment forming decentralized monitoring sites (4) for controls and transit; one second receiving radioelectric equipment (5), equipped with nondirectional aerial (M), provided near the usual switching exchange (7) of semaphoric signals (3), able to decode the signal received on a given frequency; and of one main transmitter (2), connected to aerial means (D), and provided on rescue vehicle (1); between said second receiving radioelectric equipment and usual switching exchange being provided an intelligent interface (6).

12 Claims, 4 Drawing Sheets

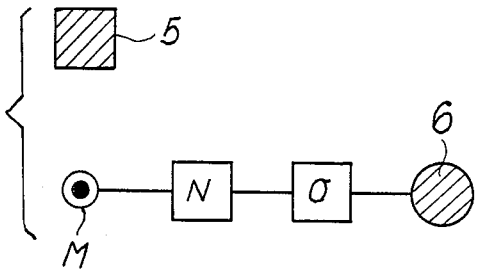
Fig. 2c
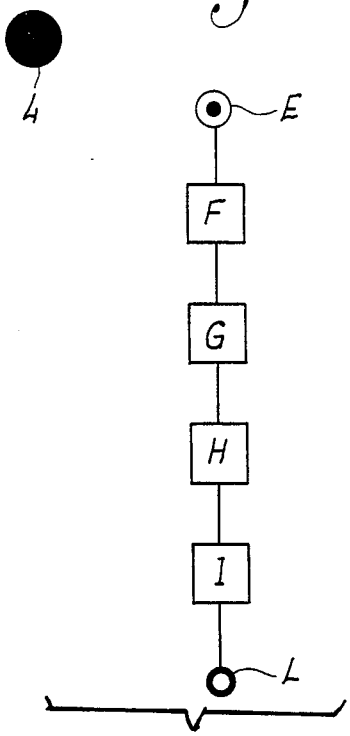
Fig. 2b
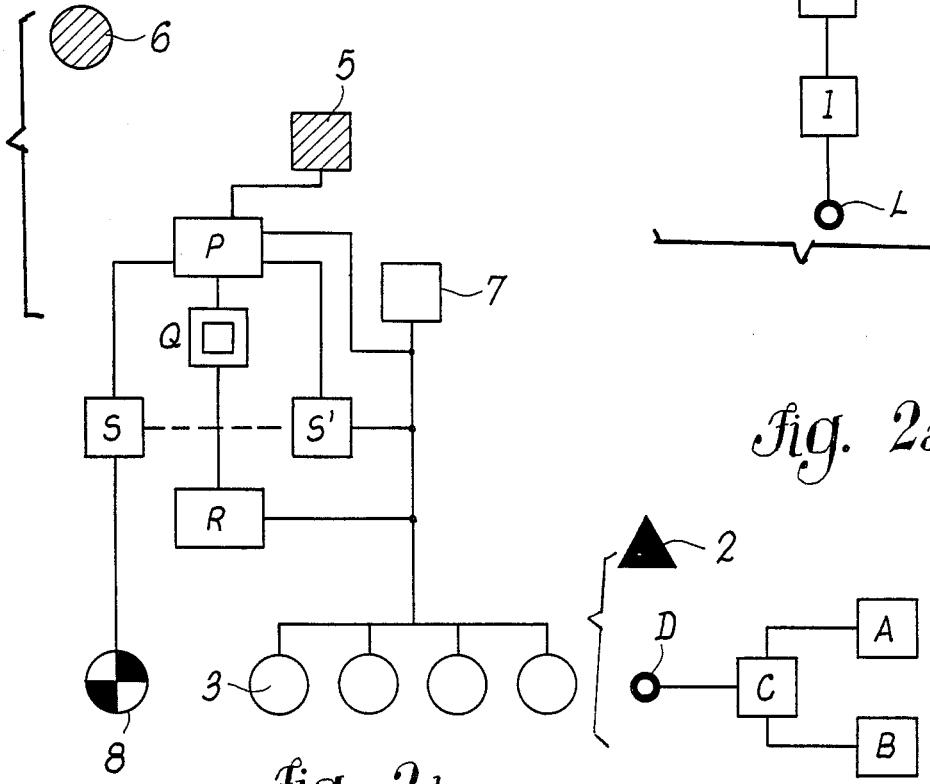
Fig. 2a
Fig. 2d

SYSTEM TO CONTROL AND TEMPORARILY ADAPT SEMAPHORIC REGULATION

BACKGROUND AND BRIEF SUMMARY OF THE INVENTION

This invention concerns an improved device to control and temporarily adapt the semaphoric regulation. Particularly the invention concerns a system of said type, to be inserted to be to rescue and public intervention vehicles advantage or of other types of emergency vehicles, or, else, to be to collective emergency prearranged plans advantage, comprising radioelectric equipments and automation contrivances coupled to present monitoring systems of networks and semaphoric groups, which can be controlled, both automatically and manually, by operative exchanges or directly be said emergency vehicles.

It is known how presently semaphoric networks can be controlled:

In most cases, through automatic time contrivances, connected to each semaphoric group;

Occasionally by destined personnel, present on the spot;

Through contrivances and systems ensuring synchronization among the different semaphoric groups, in more sophisticated cases, with the aim of adjusting said synchronization to temporary traffic conditions. Adoption of such solutions entails, quite often, the occurence of heavy difficulties for rescue and/or public intervention vehicles, which, in their emergency requirements, are bound to strict rules of semaphoric network.

There can particularly happen queues due to semaphore's red light; some flows of cars in opposite direction allowing no turning, mostly to the left; difficulties by drivers to free the road for incoming vehicles; pedestrians'flows semaphorically regulated in opposite direction to that of an incoming rescue vehicle, etc. Likewise, in some particular cases, operation of public intervention, police vehicles can be made difficult by display of semaphoric network's green signal, for instance during pursuits; thence it can be convenient to provide for signal adaptation.

Besides, one should take into account both risks and responsibility which must be taken on by drivers of rescue vehicles in connection with third party travelling under green light. At the moment, public emergency plans find implementation difficulties owing to presence of semaphoric groups which, whenever activated, reckon on regular traffic requirements, while, once deactivated create unruly traffic flows and quite harmful to any collective emergency plan.

Furthermore, the various emergency vehicles have different requirements in connection with regular traffic, for instance on the ground of their speeds, and drivers are often led to operate in unknown areas.

The main object of this invention is to supply one system to control and temporarily adapt the semaphoric regulation which is so functionally structured as to be advantageously acceptable, in any technical, functional, environmental, etc., situation.

Said objects are obtained, according to invention, through acting at level of each road crossing, or at that of crossing's nodes, in a suitable position with reference to exchange, or to exchanges, which locally manage the switching of semaphoric signals.

No interest is paid, from an operative viewpoint to which can be the upstream technical approach causing and managing said switching, which can consist indifferently of processors and/or sensors, and/or units, whichever be their type and/or level.

It is therefore the specific object of this invention a system to control and temporarily adapt the semaphoric regulation consisting of first receiving radioelectric equipment means, equipped with aerial and provided in number suitable for crossing's requirements, on roads, buildings, etc., to receive and decode signals on a given frequency; first transmitting radioelectric equipment means, equipped with aerial, suitable for retransmitting said properly reencoded signals, provided in the same number as that of said first receiving radioelectric equipment means, and coupled to latters as to form decentralized monitoring sites for controls and transit; second receiving radioelectric equipment means, equipped with aerial, provided near the normal switching exchange of semaphoric signals, able to decode the signal received on a given frequency, from said sites; and of one main transmitter, connected to aerial means provided on the rescue vehicles.

In a second embodiment of system according to invention, the same consists of first receiving radioelectric equipment means, equipped with aerial, provided in number suitable for crossing's requirements, on roads, buildings, etc., to receive and decode signals on a given frequency; first transmitting radioelectric equipment means, equipped with aerial, suitable for retransmitting said properly reencoded signals, provided in the same number as that of said first receiving radioelectric equipment means, and coupled to latter so as to form decentralized monitoring sites for controls and transit; one main transmitter, connected to aerial means, provided on rescue vehicles; one on board secondary transmitter, sending signals to said transit monitoring site; second receiving radioelectric equipment means, provided near the usual switching exchange of semaphoric signals, able to decode the signal sent, on a given frequency, from said main transmitter; and third receiving radioelectric equipment means, enslaved to an interface acting on the semaphoric system, able to decode the signals coming from said transit monitoring site, so as to instruct said interface to suitably switch the signals on the ground of following signal from said second receiving radioelectric equipment means.

Preferably, the aerial of said first receiving radioelectric equipment means is of "nondirectional" type, while that of first transmitting radioelectric equipment means is of the "directional" type.

Furtherly, the aerial of second transmitting radioelectric equipment means is of "nondirectional" type.

Still according to invention, said main transmitter can include automatic and/or manual encoding systems, and encoding means for special controls, as well as a control apparatus of transmission's power as a function of vehicle's speed.

In both suggested embodiments, there might be provided an interface between, respectively, said second radioelectric equipment means and node's semaphoric system, as well as between said third radioelectric means and node's semaphoric system.

Preferably, said interface can consist of microprocessor means for processing received signals; said microprocessor means process digital signals able to pilot an electromechanical interface, checking the actual state within semaphoric exchange under reference, checking the request for emergency operativity from an interested station, selecting the optimum solution among the available ones, according to those allowed for semaphoric node itself.

According to the invention, said microprocessor means can be not installed in special cases, when there might be foreseen the direct use of radiofrequency decoded signals to pilot the existing switching exchange of semaphoric signals, and a possible electromechanical interface.

Electromechanical interface can actually be not provided in case that microprocessor is absent.

Still according to invention, said interface can be provided with an electromechanical switch adaptable to any type of semaphoric system to which the system of the invention is to be coupled, the latter connecting, on the ground of information coming from microprocessor means, the semaphores to control system or to usual switching exchange.

Furtherly, according to the invention, said usual exchange and said interface, can be provided in a common housing, in case that intervention is not made on an already existing semaphoric node, but that a new node is implemented, being in this case just one the control system to light the semaphores'lamps.

The system according to invention can include transmitting means, consisting of an equipment sending encoded signals and, possibly, some repeaters, said transmitting means being placed within an operative exchange.

Still according to the invention, said receiving and decoding radioelectric equipment means, are advantageously connected to a data processing service, or, directly, to a suitable control centre for semaphoric control.

In an embodiment of system according to the invention, the latter may operate at the same time on interdependent semaphoric units.

It is therefore quite clear how the system according to invention may be indifferently controlled either by the emergency vehicle or an operative centre.

Advantageously, according to invention, in correspondence with the semaphoric group there can be installed acoustic and/or luminous means which, actuated by said interface of semaphoric group, may warn all users of rescue vehicle's arrival, as well as of consequent activation of temporary control system. At the same time they let the driver of rescue vehicle know that the system is operative at a given node, or they warn him about any anomalous operation of system in that node, or that said anomalous operation is possible, or lastly, they warn him about the possible contemporary arrival of another rescue vehicle at said node.

Said acoustic and/or luminous means can be used instead of preferential switching system, whenever it is not required to vary the traffic flows, but only to warn motorists and pedestrians about said vehicle's arrival.

The present invention will be now described for illustrative, but not limitative purposes, according to its preferred embodiments, as shown in the enclosed drawings.

Figure 3:
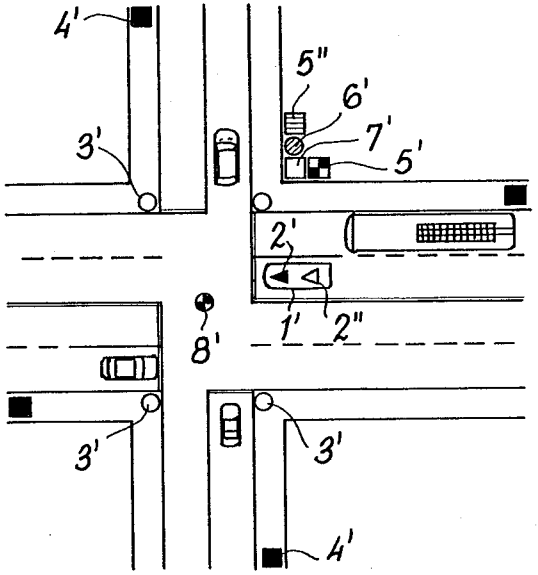
Figure 1:
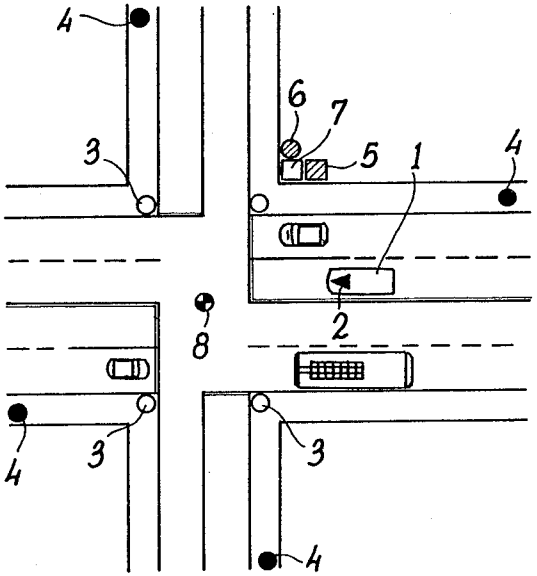
FIG. 1 shows a schematic plan view of a first embodiment of system according to invention.
Figure 3E:
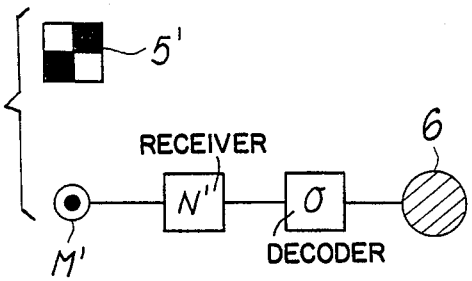
Figure 3D:
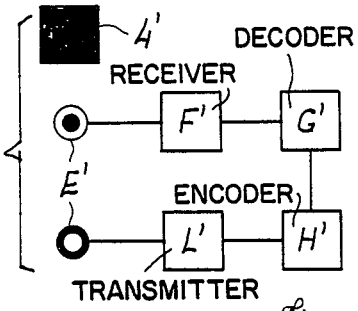
Figure 3C:
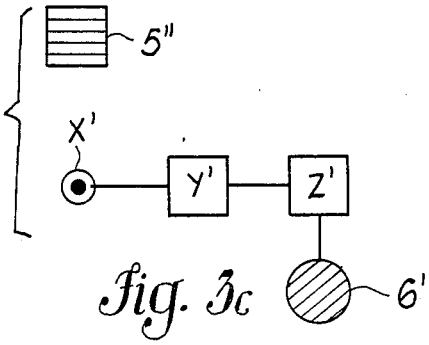
Figure 3F:
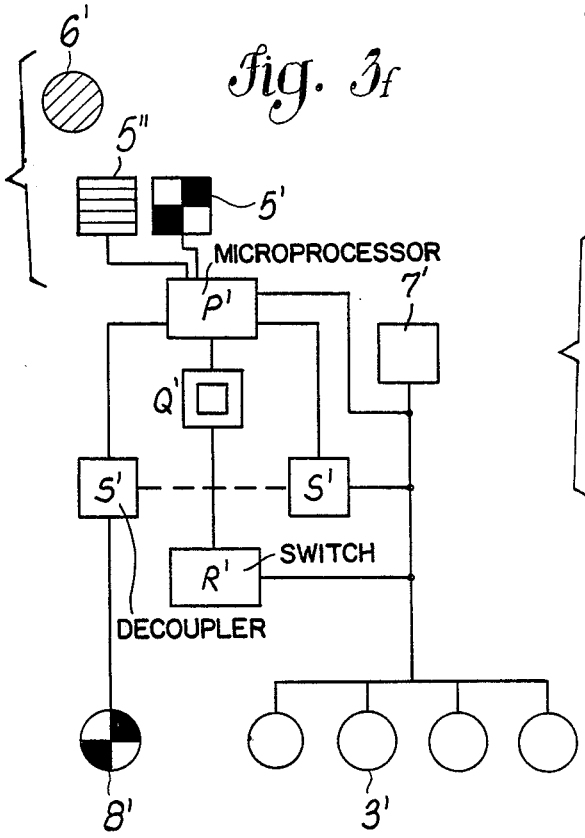
Figure 3B:
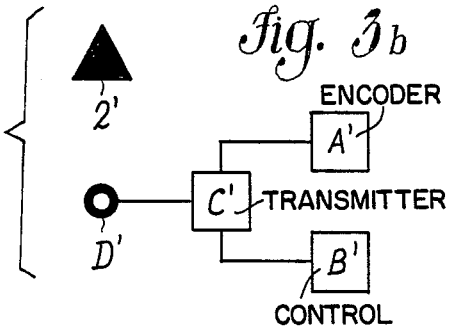
Figure 3A:
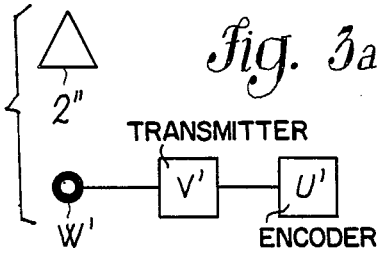
Figure 4:
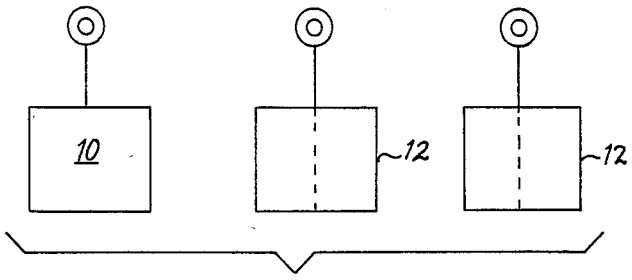

FIGS. *2a, 2b, 2c* and *2d* show block diagrams of elements making up the system according to FIG. 1;

FIG. 3 shows a schematic plan view of a second embodiment of system according to invention;

FIGS. *3a, 3b, 3c, 3d, 3e* and *3f* show block diagrams of elements making up the system according to FIG. 3; and FIG. 4 is a block diagram of an alternative embodiment of the invention.

DESCRIPTION OF THE PREFERRED EMBODIMENT(S)

Referring now to FIG. 1, by reference number 1 there is shown the rescue vehicle equipped with on board main transmitter 2. Crossing's semaphores are shown with reference number 3.

Vehicle 1 transmits, through transmitter 2, a signal showing its presence and the type of setting to be given to regulation of semaphores 3, to one of monitoring decentralized sites 4 for controls and transit. From sites 4 the signal is sent—being added the identification of arrival's direction—to main receiver 5 which, on its turn, is connected, through interface 6, to node's semaphoric system. With reference 8 there is lastly shown the service acoustic and/or luminous alarm.

Observing now FIGS. *2a–2d,* it is possible to locate more precisely the functions of each element up to now shown.

On board main transmitter 2 includes an encoder A for normal and/or special controls, as well as a control B of transmission's power, both connected to transmitter C, equipped with aerial D Signals sent by serial D are received by aerial E of site 4. In said site 4 signals, through receiver F, are decoded (G), reencoded (H) and retransmitted (transmitter I and aerial L). In element H there takes place at the same time the reencoding of controls forwarded by vehicle 1 as far as type of setting is concerned, and the encoding showing the origin of vehicle 1 itself.

Aerial M (FIG. *2c*) of receiver 5 picks up the signals sent from site 4. Signals received from receiver N and decoded (decoder 0), are then transmitted to interface 6 including, on its turn, a microprocessor P, a pilot unit Q and a switch R.

Microprocessor P (see FIG. *2d*) is also connected to usual switching exchange 7. There is also provided a de-coupling electromechanical unit S which acts: either between microprocessor P and acoustic and/or mechanical alarms 8 and between microprocessor P and semaphores 3 and between exchange 7 and semaphores 3, or between microprocessor P and one or two among semaphores 3, exchange 7 and alarms 8.

Microprocessor p processes digital signals able to pilot electromechanical unit S checking the present state in semaphores 3 and the emergency request coming from vehicle 1, and able to select the optimum solution among those available in the semaphoric node under question.

Through microprocessor P it is also possible to provide for intelligent operation of semaphoric node after passage of vehicle 1. In other words, one can program a time distribution for all signals, to be suitably managed according to traffic conditions or to type of emergency which has been set, the wait for incoming vehicle or the taking place of an emergency being the basis for system's operativity, or such as to restore, as a function of set type of emergency and/or of traffic conditions, an optimum traffic condition before returning to regime the semaphoric node.

Obviously, in case that one does not require the microprocessor, digital information coming from receiver 5 will be directly used to pilot the existing control exchange 7 of semaphoric signals.

In FIG. 3 there is shown a second embodiment of system according to invention in which, on vehicle 1, there are provided a main transmitter 2' and a secondary transmitter 2".

Transmitter 2" sends to transmit monitoring decentralized site 4 one signal showing the presence of vehicle 1', and therefore receiver 5" warns interface 6' that operative signals to come are sent from a vehicle arriving from a given direction.

Main transmitter 2' sends, on its turn, the signals to main receiver 5' connected, through interface 6', to rotary alarms 8'.

In FIGS. from 3*a* to 3*f*, there are shown the block diagrams of all FIG. 3 system components.

Particularly, main transmitter 2', decentralized sites 4', main receiver 5' and interface 6' have some elements analogous to the corresponding ones of FIG. 1 system; therefore they are simply shown by the same numerals, identified by index '.

It should only be remarked how, in case of site 4', decoder G' should only identify the signal of authorized vehicle, while encoder H should prepare a signal showing arrival's direction.

Secondary transmitter 2" will be equipped with encoder U' for recognizing the authorized vehicles, with transmitter V' and with transmitting aerial W'. When set from aerial W', the signal is picked up by aerial E' of site 4' and retransmitted to service receiver 5" through transmitter I' and aerial L'. Said receiver 5" includes a reception aerial X', a receiver Y' and a decoder Z', connected to interface 6'.

Interface 6' which, as in the previous case can or cannot be provided, has the same structural and operative features of interface 6.

Transmitter 2 or transmitter 2" can also supply information such as vehicle's destination area, index of case's seriousness or similars.

In an alternative embodiment of the invention, the system includes transmitting means 10 to send encoded signals in combination with repeaters 12. The transmitter/repeaters 10/12 can be placed within the system depending upon the requirements of the system.

This invention has been described according to its preferred embodiments but it is to be understood that changes and modifications might be made by these skilled experts in the art without departing from the scope of this invention.

Having described our invention, what we now claim is:

1. A system to control and temporarily adapt a node's semaphoric system, which system includes semaphoric signals, the components of the system provided in a number suitable for crossings requirements which comprises:

first receiving radioelectric equipment means, equipped with an aerial, to receive and decode signals on a given frequency;

first transmitting radioelectric equipment means equipped with an aerial, suitable for decoding, reencoding and retransmitting said reencoded signals, and coupled to said first receiving radioelectric equipment means so as to form transit monitoring decentralized sites;

one main transmitter connected to an aerial means, provided on a rescue vehicle; one onboard secondary transmitter, sending signals to said transit monitoring sites;

at least one traffic monitoring site comprising second receiving radioelectric equipment means, provided near a switching exchange of semaphoric signals, able to decode the signals sent on a given frequency, from the main transmitter and to transmit the decoded signals to an interface; and the interface acting on the node's semaphoric system, the interface able to receive and to decode the signals coming from said traffic monitoring sites so as to suitably switch the semaphoric signals, on the basis of the decoded signals from the traffic monitoring site.

2. System according to claim 1, characterized in that the aerial of said first receiving radioelectric equipment means, is of the "nondirectional" type.

3. System according to claim 1, characterized in that the aerial of said first transmitting radioelectric equipment means, is of the "directional" type.

4. System according to claim 1, characterized in that said main transmitter includes automatic and/or manual encoding system as well as encoding means for special controls.

5. System according to claim 1, characterized in that the interface consists of microprocessor means for processing received signals and for sending digital signals able to pilot a mechanical interface.

6. System according to claim 1, characterized in that said interface is provided with an electromechanical switch controlling the connection of semaphoric node to customary exchange or to interface.

7. System according to claim 6, characterized in that said customary exchange and said interface are placed in just one housing, the control system to light the semaphore's lamps being in common between usual exchange and interface.

8. System according to claim 1, characterized in that there are provided transmitting means housed near an operative exchange, which consist of equipment sending encoded signals.

9. A system according to claim 8 wherein the equipment is sending encoded signals includes repeaters.

10. System according to claim 1, characterized in that said second receiving radioelectric equipment means are connected to a data processing service or to a suitable control centre.

11. System according to claim 1, characterized in that it operates at the same time on several independent semaphoric units.

12. System according to claim 1, characterized in that, in correspondence with the semaphoric group, there are installed acoustic and/or luminous alarm means.

* * * * *